US009982948B2

(12) United States Patent
Lee et al.

(10) Patent No.: US 9,982,948 B2
(45) Date of Patent: May 29, 2018

(54) HEAT EXCHANGER

(71) Applicant: LG ELECTRONICS INC., Seoul (KR)

(72) Inventors: Juhyoung Lee, Gyeongsangnam-do (KR); Seongwon Bae, Gyeongsangnam-do (KR)

(73) Assignee: LG ELECTRONICS INC., Seoul (KR)

( * ) Notice: Subject to any disclaimer, the term of this patent is extended or adjusted under 35 U.S.C. 154(b) by 358 days.

(21) Appl. No.: 14/582,803

(22) Filed: Dec. 24, 2014

(65) Prior Publication Data

US 2015/0184951 A1 Jul. 2, 2015

(30) Foreign Application Priority Data

Dec. 24, 2013 (KR) ..... 10-2013-0162821

(51) Int. Cl.
*F28F 1/32* (2006.01)
*F28D 1/053* (2006.01)

(52) U.S. Cl.
CPC ..... *F28D 1/053* (2013.01); *F28F 1/32* (2013.01); *F28F 2275/04* (2013.01); *F28F 2275/12* (2013.01)

(58) Field of Classification Search
CPC ..... F28F 1/126; F28F 1/14; F28F 1/22
(Continued)

(56) References Cited

U.S. PATENT DOCUMENTS 1,315,249 A * 9/1919 Spery ..... F28F 1/128 165/152
1,381,655 A * 6/1921 Opitz ..... F28D 1/0316 165/152

(Continued)

FOREIGN PATENT DOCUMENTS

| | | |
|---|---|---|
| EP | 1 586 844 A1 | 10/2005 |
| GB | 1 582 831 A | 1/1981 |
| JP | S60-105893 A | 6/1985 |

OTHER PUBLICATIONS

European Search Report issued in Application No. 14200050.4 dated Jun. 19, 2015.

*Primary Examiner* — Allen Flanigan
(74) *Attorney, Agent, or Firm* — KED & Associates, LLP

(57) ABSTRACT

According to the present invention, a heat exchanger comprises a plurality of coolant tubes; a plurality of fins contacting the plurality of coolant tubes, wherein each of the plurality of fins comprises: a plurality of fin parts spaced apart from each other; an upper fin part connecting part connecting respective upper portions of the plurality of fin parts with each other, the upper fin part connecting part contacting one of the plurality of coolant tubes; a lower fin part connecting part connecting respective lower portions of the plurality of fin parts with each other, the lower fin part connecting part contacting another one of the plurality of coolant tubes; an upper opening formed at an upper portion of each of the plurality of fin parts; a lower opening formed at a lower portion of each of the plurality of fin parts; an upper protrusion protruded from an upper portion of each of the plurality of fin parts, the upper protrusion contacting the first coolant tube; and a lower protrusion protruded from a lower portion of each of the plurality of fin parts, the lower protrusion contacting the second coolant tube. Accordingly,
(Continued)

the present invention provides increased productivity without the need of a separate pipe expanding process.

18 Claims, 3 Drawing Sheets

(58) Field of Classification Search
USPC ..... 165/152, 181
See application file for complete search history.

(56) References Cited

U.S. PATENT DOCUMENTS

| | | | | | |
|---|---|---|---|---|---|
| 1,399,571 | A | * | 12/1921 | Neveu | F28D 1/0316 165/152 |
| 1,789,591 | A | * | 1/1931 | McIntyre | F25B 39/04 165/150 |
| 1,863,026 | A | * | 6/1932 | Palmer | F28F 1/128 165/152 |
| 1,886,498 | A | * | 11/1932 | Phelps | F25B 39/04 165/131 |
| 1,950,488 | A | * | 3/1934 | Gillean | F28D 1/0316 165/152 |
| 1,950,500 | A | * | 3/1934 | Loprich et al. | F28F 1/126 165/152 |
| 2,119,761 | A | * | 6/1938 | Wentworth | F28F 1/126 165/150 |
| 2,164,005 | A | * | 6/1939 | Booth | F28D 1/0316 165/122 |
| 2,195,259 | A | * | 3/1940 | Ramsaur | F25B 39/04 165/150 |
| 2,970,812 | A | * | 2/1961 | Kritzer | F28D 7/04 165/152 |
| 3,407,874 | A | | 10/1968 | Gier, Jr. | |
| 2012/0199328 | A1 | | 8/2012 | Gong | |

* cited by examiner

HEAT EXCHANGER

CROSS-REFERENCE TO RELATED APPLICATIONS

This application claims priority under 35 U.S.C. § 119 to Korean Application No. 10-2013-0162821 filed on Dec. 24, 2013, whose entire disclosure is hereby incorporated by reference.

BACKGROUND

1. Field

The present invention relates to a heat exchanger, and particularly, to a heat exchanger having a plurality of coolant tubes.

2. Background

In general, heat exchangers are apparatuses for transferring heat between two fluids, and the heat exchangers are widely used for cooling or heating rooms or supplying hot water.

A heat exchanger may function as a waste heat recovery heat exchanger for recovering waste heat, a cooler for cooling a fluid on a high-temperature side, a heater for heating a fluid on a low-temperature side, a condenser for condensing a coolant, or an evaporator for evaporating a coolant.

There may be various types of heat exchangers including a fin tube-type heat exchanger having a tube through which a first fluid passes and a fin provided on the tube, a shell tube-type heat exchanger having a shell through which a first fluid passes and a tube through which a second fluid passes to exchange heat with the first fluid, and a plate-type heat exchanger having a first fluid and a second fluid pass through with a plate-shaped heat transfer plate interposed therebetween.

Among the heat exchangers, the fin tube-type heat exchanger may include a plurality of coolant tubes through which a coolant passes to exchange heat with ambient air.

SUMMARY OF THE INVENTION

The present invention aims to provide an easy-to-manufacture heat exchanger in which coolant tubes and fins may be securely supported.

According to the present invention, a heat exchanger comprises a plurality of coolant tubes; and a plurality of fins contacting the plurality of coolant tubes, wherein each of the plurality of fins comprises a plurality of fin parts spaced apart from each other; a plurality of fin part connecting parts connecting the plurality of fin parts with each other, the plurality of fin part connecting parts contacting a first coolant tube of the plurality of coolant tubes; and a plurality of protrusions respectively protruded from the plurality of fin parts, the plurality of protrusions contacting the first coolant tube.

The plurality of fin part connecting parts and the plurality of protrusions may be formed at upper portions and lower portions of the plurality of fin parts.

At least a portion of each of the plurality of protrusions may be parallel with a portion of each of the plurality of fin part connecting parts.

The plurality of protrusions may be shorter in length than the plurality of fin part connecting parts.

The plurality of protrusions may be spaced apart from the plurality of fin part connecting parts.

Each of the plurality of fin part connecting parts may include a plurality of contacting parts jointly contacting the first coolant tube, and the plurality of contacting parts may be spaced apart from each other in parallel with each other.

Each of the plurality of coolant tubes may be shaped as a hollow straight pipe, and the plurality of contacting parts each may have a curved surface that comes in surface contact with a portion of the first coolant tube.

One of the plurality of contacting parts may be positioned ahead of the coolant tubes in a direction where air flows, and another one of the plurality of contacting parts may be positioned behind the coolant tubes in the direction where air flows.

A fin part connecting part of one of the plurality of fins and a fin part connecting part of another one of the plurality of fins may jointly contact the same coolant tube.

A fin part of one of the plurality of fins may contact a fin part of another one of the plurality of fins.

The plurality of fins may include a circular hole formed between an opening of one of the plurality of fins and an opening of another one of the plurality of fins, a coolant tube passing through the circular hole.

According to the present invention, a heat exchanger comprises a plurality of coolant tubes; a plurality of fins contacting the plurality of coolant tubes, wherein each of the plurality of fins comprises: a plurality of fin parts spaced apart from each other; an upper fin part connecting part connected with respective upper portions of the plurality of fin parts, the upper fin part connecting part contacting a first coolant tube of the plurality of coolant tubes; a lower fin part connecting part connected with respective lower portions of the plurality of fin parts, the lower fin part connecting part contacting a second coolant tube of the plurality of coolant tubes; an upper opening formed at an upper portion of each of the plurality of fin parts; a lower opening formed at a lower portion of each of the plurality of fin parts; an upper protrusion protruded from an upper portion of each of the plurality of fin parts, the upper protrusion contacting the first coolant tube; and a lower protrusion protruded from a lower portion of each of the plurality of fin parts, the lower protrusion contacting the second coolant tube.

The upper fin part connecting part and the lower fin part connecting part each may include a pair of contacting parts contacting a coolant tube, the pair of contacting parts spaced apart from each other in parallel with each other.

A longitudinal direction of each of the pair of contacting parts may be parallel with a longitudinal direction of the coolant tubes.

Each of the plurality of coolant tubes is shaped as a hollow straight pipe, and the pair of contacting parts each may have a curved surface that comes in surface contact with a portion of the coolant tube.

The upper protrusion and the lower protrusion each may be shorter in length than each of the pair of contacting parts.

A height of each of the plurality of fin parts may be larger than an interval between a pair of adjacent coolant tubes.

The upper fin part connecting part and the lower fin part connecting part may extend in opposite directions thereof with respect to the plurality of fin parts.

The upper protrusion and the lower protrusion may protrude in opposite directions thereof with respect to the plurality of fin parts.

At least a portion of the upper protrusion may be parallel with a portion of the upper fin part connecting part, and at least a portion of the lower protrusion may be parallel with a portion of the lower fin part connecting part.

A lower fin part connecting part of a first fin of the plurality of fins, which is positioned at an upper side, and an upper fin part connecting part of a second fin of the plurality of fins, which is positioned at a lower side, may jointly contact the same coolant tube.

A lower fin part connecting part of a first fin of the plurality of fins, which is positioned at an upper side, may contact an upper fin part connecting part of a second fin of the plurality of fins, which is positioned at a lower side.

The plurality of fins may have a circular hole formed between a lower opening formed in a first fin of the plurality of fins, which is positioned at an upper side, and an upper opening formed in a second fin of the plurality of fins, which is positioned at a lower side, a coolant tube passing through the circular hole.

The lower opening and the upper opening each may be semi-circular in shape.

The upper fin part connecting part and the lower fin part connecting part may be alternately and repeatedly formed between the plurality of fin parts.

A first fin part of the plurality of fin parts, the upper fin part connecting part, a second fin part of the plurality of fin parts, and the lower fin part connecting part may be sequentially arranged along a longitudinal direction of each of the plurality of fins.

In the heat exchanger according to the present invention configured as above, a plurality of fins may be inserted between a plurality of coolant tubes in a direction parallel with a longitudinal direction of the coolant tubes, thus allowing for increased productivity without the need of a pipe expanding process for bringing the coolant tubes in tight contact with the fins.

Further, the protrusions are brought in contact with the coolant tubes, thus more securely supporting the coolant tubes.

Further, a plurality of contacting parts of fin part connecting parts may come in surface contact with portions of the coolant tubes while surrounding the portions of the coolant tubes, allowing for a maximized heat transfer area between the coolant tubes and the fins upon heat exchange.

Further, the protrusions, together with the fin part connecting parts, may transfer heat, thus leading to an increased heat transfer capability.

BRIEF DESCRIPTION OF THE DRAWINGS

The embodiments will be described in detail with reference to the following drawings in which like reference numerals refer to like elements wherein.

DETAILED DESCRIPTION

Hereinafter, a heat exchanger according to an embodiment of the present invention is described with reference to the accompanying drawings.

Figure 1:
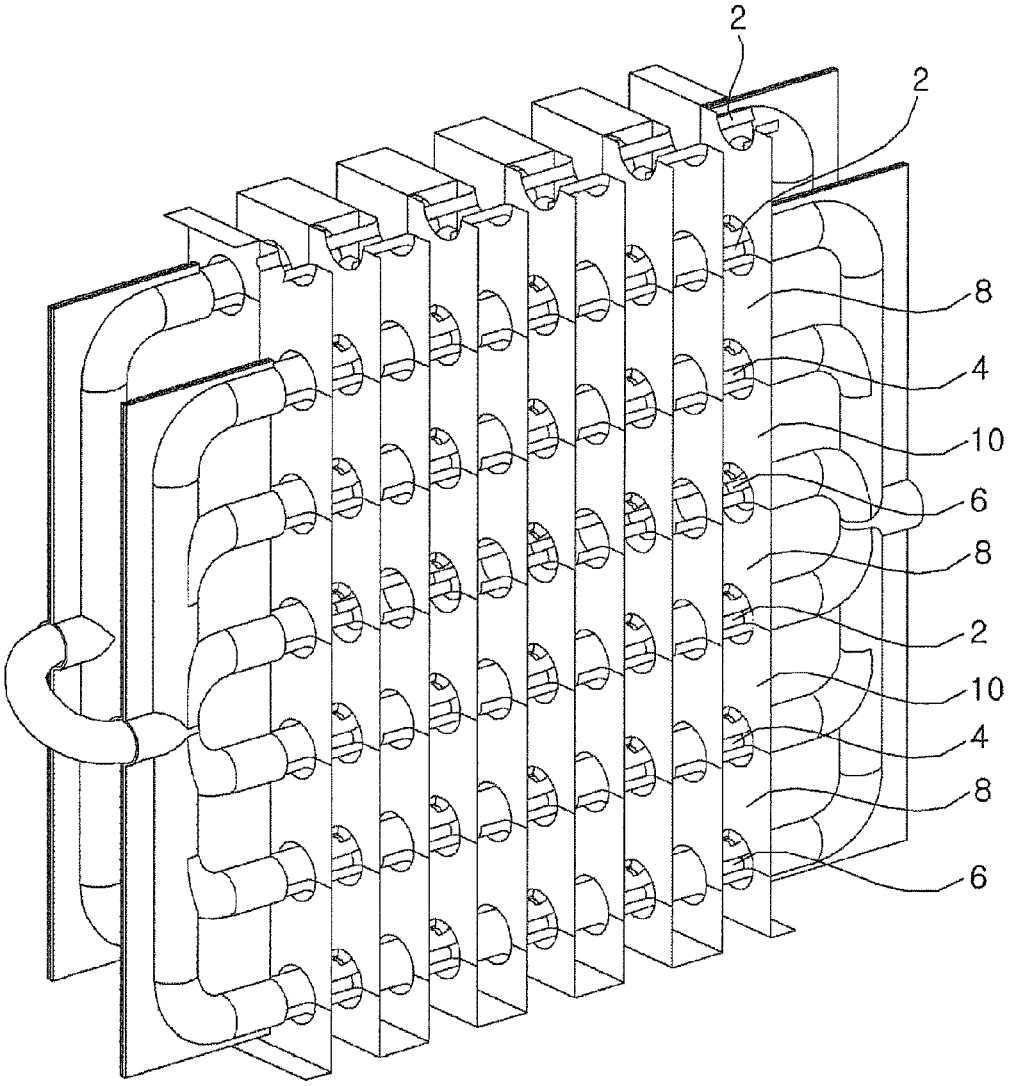
FIG. 1 is a perspective view illustrating a heat exchanger according to an embodiment of the present invention.
Figure 2:
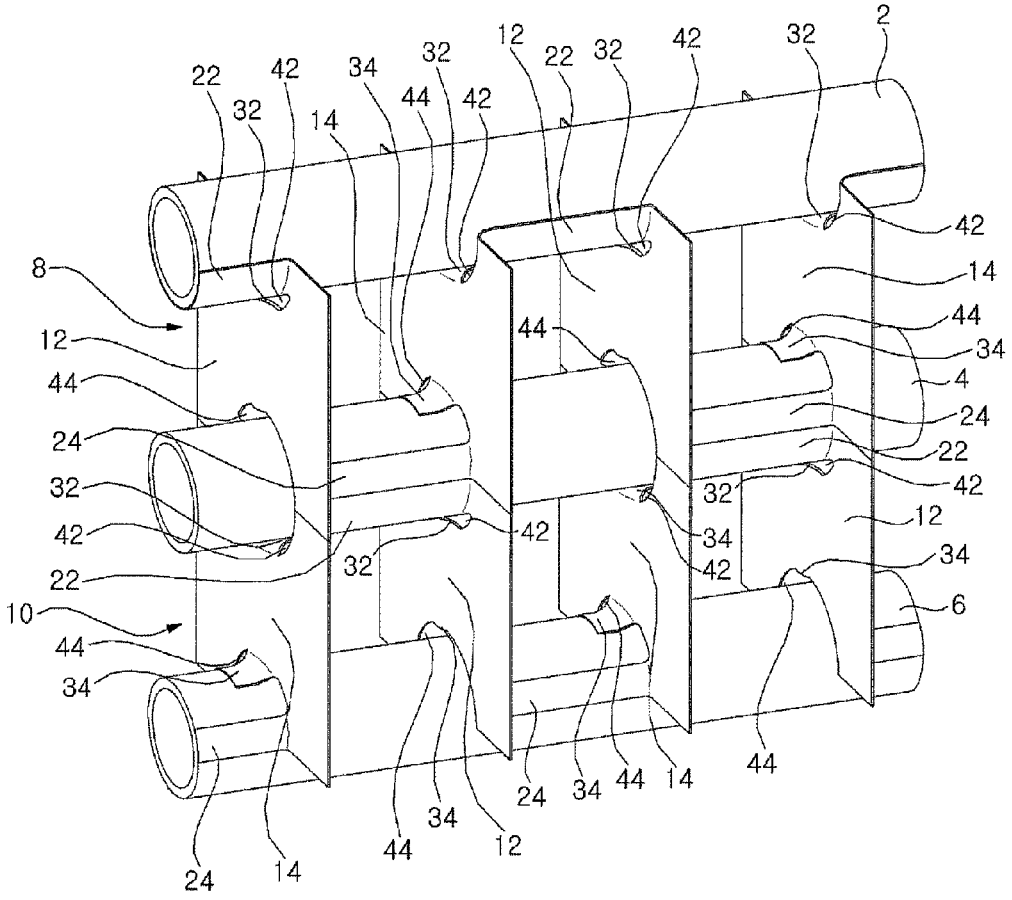
FIG. 2 is a perspective view illustrating a heat exchanger with a portion thereof cut away, according to an embodiment of the present invention.
Figure 3:
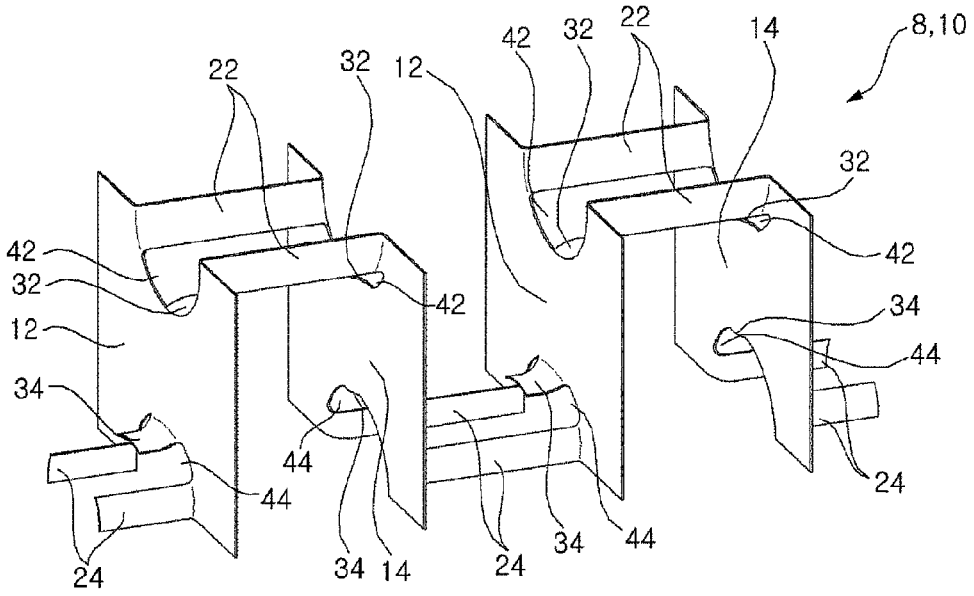
FIG. 3 is a perspective view illustrating some fins of a heat exchanger with a portion thereof cut away, according to an embodiment of the present invention.

FIG. 1 is a perspective view illustrating a heat exchanger according to an embodiment of the present invention. FIG. 2 is a perspective view illustrating a heat exchanger with a portion thereof cut away, according to an embodiment of the present invention. FIG. 3 is a perspective view illustrating some fins of a heat exchanger with a portion thereof cut away, according to an embodiment of the present invention.

According to an embodiment of the present invention, a heat exchanger includes a plurality of coolant tubes 2, 4, and 6 and a plurality of fins 8 and 10.

The plurality of coolant tubes 2, 4, and 6 each may be shaped as a hollow straight pipe.

The plurality of coolant tubes 2, 4, and 6 may be arranged in parallel with each other.

The plurality of coolant tubes 2, 4, and 6 may be spaced apart from each other in a direction perpendicular to their longitudinal direction.

The plurality of coolant tubes 2, 4, and 6 each may be arranged long in a horizontal direction. The plurality of coolant tubes 2, 4, and 6 may be spaced apart from each other in a vertical direction. The plurality of coolant tubes 2, 4, and 6 may be arranged at the same intervals.

The number of the plurality of coolant tubes 2, 4, and 6 is not limited, and for example, the number of coolant tubes 2, 4, and 6 may be selected within a range from 3 to 20 or the number thereof may be 2 or more than 20.

The plurality of fins 8 and 10 each may come in contact with at least one coolant tube.

The plurality of fins 8 and 10 may include at least one fin that comes in contact with two coolant tubes. The plurality of fins 8 and 10 may include at least one fin that comes in contact with one coolant tube. The plurality of fins 8 and 10 may include at least one first fin contacting two coolant tubes and at least one second fin contacting one coolant tube.

At least one of an upper portion and a lower portion of each of the plurality of fins 8 and 10 may come in contact with a coolant tube.

The plurality of fins 8 and 10 each may be inserted between a plurality of coolant tubes in a direction parallel with a longitudinal direction of the coolant tubes.

Pairs of adjacent fins 8 and 10 may come in contact with the same coolant tube. In case the upper one of a pair of adjacent fins is called an upper fin 8, and the lower one of the pair of adjacent fins is called a lower fin 10, the upper fin 8 may contact an upper portion of a coolant tube, and the lower fin 10 may contact a lower portion of the coolant tube. The upper fin 8 and the lower fin 10 may contact each other. A lower end of the upper fin 8 may contact an upper end of the lower fin 10.

A first fin may exchange heat with two coolant tubes, an upper portion of the first fin may contact a coolant tube of a pair of adjacent coolant tubes, which is positioned relatively at an upper side, and a lower portion of the first fin may contact a coolant tube of the pair of adjacent coolant tubes, which is positioned relatively at a lower side.

A second fin may exchange heat with one coolant tube, and only one of an upper portion and a lower portion of the second fin may contact the coolant tube.

In case, among the plurality of fins included in the heat exchanger, the second fin is positioned at an uppermost side (i.e., an uppermost fin), a lower portion of the second fin may contact a lower portion of a coolant tube positioned at an uppermost side among the plurality of coolant tubes.

In case, among the plurality of fins included in the heat exchanger, the second fin is positioned at a lowermost side (i.e., a lowermost fin), an upper portion of the second fin may contact an upper portion of a coolant tube positioned at a lowermost side among the plurality of coolant tubes.

In the heat exchanger, the number of fins may be one more than the number of the coolant tubes, and in such case, the heat exchanger may include both the first fin contacting two coolant tubes and the second fin contacting one coolant tube. In the heat exchanger, a coolant tube positioned at an uppermost side of the plurality of coolant tubes may contact a lower portion of a second fin (i.e., the uppermost fin). In the heat exchanger, a coolant tube positioned at a lowermost side of the plurality of coolant tubes may contact an upper portion of another second fin (i.e., the lowermost fin). In the heat exchanger, the first fins each may be positioned between the plurality of coolant tubes. In this case, the respective upper portions of the first fins may contact a coolant tube that is positioned relatively at an upper side, and the respective upper portions thereof may contact another coolant tube that is positioned relatively at a lower side.

Meanwhile, in the heat exchanger, the number of fins may be one less than the number of the coolant tubes, and in such case, the heat exchanger may include the plurality of coolant tubes and a plurality of first fins contacting two coolant tubes without any second fin. In the heat exchanger, the first fins each may be positioned between the plurality of coolant tubes. The respective upper portions of the first fins may contact a coolant tube that is positioned relatively at an upper side, and the respective upper portions thereof may contact another coolant tube that is positioned relatively at a lower side.

The plurality of fins 8 and 10 each may contact the same coolant tube at a plurality of portions.

The plurality of fins 8 and 10 each may include a plurality of fin parts 12 and 14 spaced apart from each other. The plurality of fin parts 12 and 14 forming one fin may be positioned in parallel with each other. In other words, the plurality of fins 8 and 10 each may include the plurality of fin parts 12 and 14 positioned in parallel with each other.

The plurality of fin parts 12 and 14 may be spaced apart from each other in a direction parallel with a longitudinal direction of the coolant tubes. The plurality of fin parts 12 and 14 may be spaced apart at the same intervals from each other in a direction parallel with a longitudinal direction of the coolant tubes.

The plurality of fin parts 12 and 14 each may be formed long in a direction perpendicular to a longitudinal direction of the coolant tubes. The plurality of fin parts 12 and 14 each may be longer than the diameter of the coolant tubes in a direction along which air is guided. The height of each of the plurality of fin parts 12 and 14 may be larger than the interval between a pair of adjacent coolant tubes.

In case air passes through the heat exchanger in front and rear directions, the plurality of fin parts 12 and 14 each may be formed long in upper and lower directions, and the length in front and rear directions of each of the plurality of fin parts 12 and 14 may be larger than the diameter of the coolant tubes. The height of each of the plurality of fin parts 12 and 14 may be larger than the interval between a pair of coolant tubes spaced apart from each other in upper and lower directions.

A portion of each of the plurality of fin parts 12 and 14 may be positioned ahead of the coolant tubes in a direction where air flows. Another portion of each of the plurality of fin parts 12 and 14 may be positioned behind the coolant tubes in a direction where air flows.

The number of fin parts 12 and 14 included in the heat exchanger is not limited to two, and the number may be selected with a range from 2 to 20. For example, the number of fin parts may be more than 20.

The plurality of fins 8 and 10 each include fin part connecting parts 22 and 24 connecting the plurality of fin parts 12 and 14 with each other. The fin part connecting parts 22 and 24 may contact a coolant tube.

The fin part connecting parts 22 and 24 may include a plurality of contacting parts jointly contacting the same coolant tube. The plurality of contacting parts may be spaced apart from each other in parallel with each other.

The plurality of contacting parts each may support the coolant tube, and the plurality of contacting parts, in combination, may fasten the coolant tube. The load of the coolant tubes may be distributed to the plurality of contacting parts.

The plurality of contacting parts each may exchange heat with the coolant tubes. The plurality of contacting parts may independently come in surface contact with different areas of the coolant tubes, and the plurality of contacting parts each may have a curved surface for surface contact.

One of the plurality of contacting parts may be positioned ahead of the coolant tubes in a direction where air flows, and another of the plurality of contacting parts may be positioned behind the coolant tubes in the direction where air flows.

The plurality of fins 8 and 10 each may include a plurality of fin part connecting parts 22 and 24. The plurality of fin part connecting parts 22 and 24 each may include a pair of contacting parts spaced in parallel apart from each other. One of the pair of contacting parts may be positioned ahead of the coolant tubes in the direction where air flows, and the other of the pair of contacting parts may be positioned behind the coolant tubes in the direction where air flows.

The plurality of fins 8 and 10 each include protrusions 32 and 34 respectively protruded from the plurality of fin parts 12 and 14.

The protrusions 32 and 34 may contact the coolant tube contacted by the fin part connecting parts 22 and 24.

At least a portion of the protrusions 32 and 34 may be positioned parallel with a portion of the fin part connecting parts 22 and 24.

The respective first ends of the protrusions 32 and 34 may be connecting ends connected with the fin parts, and the respective second ends of the protrusions 32 and 34 may be free ends. The protrusions 32 and 34 may be elastically deformed in an opposite direction of a coolant tube when brought in contact with the coolant tube to thereby support the coolant tube.

The protrusions 32 and 34 may include curved surfaces that come in surface contact with a portion of the coolant tube while surrounding the portion of the coolant tube, exchanging heat with the coolant tube.

The protrusions 32 and 34 may be shorter in length than the fin part connecting parts 22 and 24. The protrusions 32 and 34 may be spaced apart from the fin part connecting parts 22 and 24.

The plurality of fins 8 and 10 each may include a plurality of protrusions 32.

The plurality of fin parts 12 and 14 each may include openings 42 and 44 through which a coolant tube passes. Each of the openings 42 and 44 may be semi-circular in shape. A coolant tube may sequentially pass through the openings of the plurality of fin parts 12 and 14.

The openings 42 and 44 of the plurality of fins 8 and 10, through which coolant tubes pass, may be formed opposite each other. The opening 44 of one (e.g., fin 8) of the plurality of fins 8 and 10 may face the opening 42 of the other (e.g., fin 10) of the plurality of fins 8 and 10.

The fin part 12 of one (e.g., fin 8) of the plurality of fins 8 and 10 may contact the fin part 14 of the other (e.g., fin 10) of the plurality of fins 8 and 10. A lower end of the fin part 12 of an upper fin 8, which is positioned at an upper side of the plurality of fins 8 and 10, may contact an upper end of the fin part 14 of a lower fin 10, which is positioned at a lower side of the plurality of fins 8 and 10.

The fin part connecting part 22 of one (e.g., fin 8) of the plurality of fins 8 and 10 may contact the fin part connecting part 24 of the other (e.g., fin 10) of the plurality of fins 8 and 10. A lower end of the fin part connecting part 24 of an upper fin 8, which is positioned at an upper side of the plurality of fins 8 and 10, may contact an upper end of the fin part connecting part 22 of a lower fin 10, which is positioned at a lower side of the plurality of fins 8 and 10. The fin part connecting part 24 of the upper fin 8, which is positioned at the upper side of adjacent fins 8 and 10, and the fin part connecting part 22 of the lower fin 10, which is positioned at the lower side of the adjacent fins 8 and 10, may surround the other area of an upper portion and a lower portion of a coolant tube.

The fin part connecting part 22 and the protrusion 32 may be formed at an upper portion of each of the plurality of fin parts 12 and 14, and the fin part connecting part 24 and the protrusion 34 may be formed at a lower portion of each of the plurality of fin parts 12 and 14.

The opening 42 may be formed at an upper portion of each of the plurality of fin parts 12 and 14, and the opening 44 may be formed at a lower portion of each of the plurality of fin parts 12 and 14.

Each of the plurality of fins 8 and 10 may include a plurality of fin parts 12 and 14 spaced apart from each other; an upper fin part connecting part 22 connected to the respective upper portions of the plurality of fin parts 12 and 14 and contacting one of the plurality of coolant tubes; and a lower fin part connecting part 24 connected to the respective lower portions of the plurality of fin parts 12 and 14 and contacting another one of the plurality of coolant tubes.

The upper fin part connecting part 22 and the lower fin part connecting part 24 may extend in opposite directions thereof with respect to the fin parts 12 and 14. With respect to one (e.g., fin part 12) of the plurality of fin parts 12 and 14, the upper fin part connecting part 22 may extend to the right from an upper portion of the fin part 12, and the lower fin part connecting part 24 may extend to the left from a lower portion of the fin part 12.

In contrast, with respect to the other (e.g., fin part 14) of the plurality of fin parts 14 and 14, the upper fin part connecting part 22 may extend to the left from an upper portion of the fin part 14, and the lower fin part connecting part 24 may extend to the right from a lower portion of the fin part 14.

Upper fin part connecting parts 22 and lower fin part connecting parts 24 may be alternately and repeatedly formed between the plurality of fin parts 12 and 14 in a longitudinal direction of each of the plurality of fins 8 and 10. Here, the longitudinal direction of each of the plurality of fins may be parallel with a longitudinal direction of the coolant tubes. A pair of fin parts 12 and 14 may be connected with each other via only one of the upper fin part connecting part 22 and the lower fin part connecting part 24.

In each of the plurality of fins 8 and 10, one (e.g., fin part 12) of the plurality of fin parts 12 and 14, the upper fin part connecting part 22, the other (e.g., fin part 14) of the plurality of fin parts 12 and 14, and the lower fin part connecting part 24 may be sequentially arranged along a longitudinal direction of the plurality of fins 8 and 10.

The upper fin part connecting part 22 and the lower fin part connecting part 24 each may include a pair of contacting parts contacting a coolant tube, and the pair of contacting parts may be spaced apart from each other. Each coolant tube may be shaped as a hollow straight pipe, and each of the pair of contacting parts may have a curved surface that comes in surface contact with a portion of the coolant tube.

The pair of contacting parts each may be formed in a longitudinal direction thereof, which is parallel with a longitudinal direction of the coolant tube, and each contacting part may function as a bridge connecting the pair of fin parts 12 and 14 with each other to exchange heat with the coolant tube.

The plurality of fins 8 and 10 each may include an upper protrusion 32 protruded from an upper portion of the fin parts 12 and 14 and contacting the coolant tube contacted by the upper fin part connecting part 22 and a lower protrusion 34 protruded from a lower portion of the fin parts 12 and 14 and contacting the coolant tube contacted by the lower fin part connecting part 24.

The upper protrusion 32 and the lower protrusion 34 may be protruded in opposite directions thereof with respect to the fin parts 12 and 14.

With respect to one (e.g., fin part 12) of the plurality of fin parts 12 and 14, the upper protrusion 32 may extend to the right from an upper portion of the fin part 12, and the lower protrusion 34 may extend to the left from a lower portion of the fin part 12.

In contrast, with respect to the other (e.g., fin part 14) of the plurality of fin parts 12 and 14, the upper protrusion 32 may extend to the left from an upper portion of the fin part 14, and the lower protrusion 34 may extend to the right from a lower portion of the fin part 14.

The upper protrusion 32 protruded from the upper portion of the fin part 12 and the upper protrusion 32 protruded from the upper portion of the fin part 14 may face each other.

The lower protrusion 34 protruded from the lower portion of the fin part 12 and the lower protrusion 34 protruded from the lower portion of the fin part 14 may face each other.

At least a portion of the upper protrusion 32 may be positioned parallel with a portion of the upper fin part connecting part 22. The upper protrusion 32 may be shorter in length than each of a pair of contacting parts forming the upper fin part connecting part 22. At least a portion of the upper protrusion 32 may be positioned parallel with a portion of each of a pair of contacting parts forming the upper fin part connecting part 22.

At least a portion of the lower protrusion 34 may be positioned parallel with a portion of the lower fin part connecting part 24. The lower protrusion 34 may be shorter in length than each of a pair of contacting parts forming the lower fin part connecting part 24. At least a portion of the lower protrusion 34 may be positioned parallel with a portion of each of a pair of contacting parts forming the lower fin part connecting part 24.

The plurality of fins 8 and 10 may be configured so that the lower fin part connecting part 24 of the fin 8 positioned at an upper side and the upper fin part connecting part 22 of the fin 10 positioned at a lower side may contact the same coolant tube 4. The coolant tube 4 may contact each of the lower fin part connecting part 24 of the fin 8 positioned at an upper side of the plurality of fins 8 and 10 and the upper fin part connecting part 22 of the fin 10 positioned at a lower side of the plurality of fins 8 and 10.

The lower fin part connecting part 24 of the fin 8 positioned at an upper side of the plurality of fins 8 and 10 may contact the upper fin part connecting part 22 of the fin 10 positioned at a lower side. An upper end of the pair of contacting parts of the lower fin part connecting part 24 may contact a lower end of the pair of contacting parts of the upper fin part connecting part 22.

The plurality of fins 8 and 10 each may include upper openings 42 formed at an upper portion of each of the plurality of fin parts 12 and 14 and lower openings 44 formed at a lower portion of each of the plurality of fin parts 12 and 14.

Each of the upper and lower openings 42 and 44 may be semi-circular in shape.

The lower opening 44 of the fin 8 positioned at an upper side of the plurality of fins 8 and 10 may contact the upper opening 42 of the fin 10 positioned at a lower side. The plurality of fins 8 and 10 may include a circular hole formed between the lower opening 44 of the fin 8 positioned at an upper side of the plurality of fins 8 and 10 and the upper opening 42 of the fin 10 positioned at a lower side of the plurality of fins 8 and 10, wherein a coolant tube passes through the circular hole.

In the heat exchanger, fins may be inserted between two coolant tubes in a direction parallel with a longitudinal direction of the coolant tubes, with a plurality of coolant tubes positioned in parallel with each other, and the fins may be brought in contact with the coolant tubes. The fins may contact the coolant tubes at a plurality of areas.

In the heat exchanger, the fins may be joined with the coolant tubes by a furnace brazing process with the fins contacting the coolant tubes, and in such case, the heat exchanger does not require a separate tube expanding process for tightly coupling the coolant tubes with the fins, thus leading to a simplified process for assembling the heat exchanger.

Hereinafter, an operation of the above configuration according to the present invention is described.

A coolant may pass through each coolant tube of the heat exchanger. The fins 8 and 10 may exchange heat between the coolant and air while the fin part connecting parts 22 and 24 and the protrusions 32 and 34 each contact the coolant tubes. A portion of each coolant tube is covered by the fin part connecting parts 22 and 24 and the protrusions 32 and 34, and the remainder thereof is exposed to the outside without being covered by the fins 8 and 10.

Air may come in contact with the exposed portion of each coolant tube 2, 4, and 6, the fin part connecting parts 22 and 24, the protrusions 32 and 34, and the fin parts 12 and 14 to perform heat exchange.

An example where the ambient air of the heat exchanger is higher in temperature than the coolant is described below.

The exposed portion of each coolant tube 2, 4, and 6 may absorb heat from air, and the absorbed heat may be transferred to the coolant through all of the coolant tubes 2, 4, and 6. The fin parts 12 and 14 may absorb the heat from air and transfer the absorbed heat to the fin part connecting parts 22 and 24 and the protrusions 32 and 34. The fin part connecting parts 22 and 24 and the protrusions 32 and 34 each may transfer the heat directly absorbed from air and the heat transferred from the fin parts 12 and 14 to the coolant tubes.

An example where the temperature of the coolant is higher than the temperature of the ambient air of the heat exchanger is described below.

The coolant tubes 2, 4, and 6 may absorb heat from the coolant and may transfer part of the absorbed heat to air through the exposed portion of the coolant tubes 2, 4, and 6. The coolant tubes 2, 4, and 6 may transfer the remainder of the heat absorbed from the coolant to the fin part connecting parts 22 and 24 and the protrusions 32 and 34. The fin part connecting parts 22 and 24 may directly transfer part of the heat transferred from the coolant tubes to air and may transfer the rest of the heat transferred from the coolant tubes to the fin parts 12 and 14. The protrusions 32 and 34 may directly transfer part of the heat transferred from the coolant tubes to air and may transfer the rest of the heat transferred from the coolant tubes to the fin parts 12 and 14. The fin parts 12 and 14 may transfer the heat from the fin part connecting parts 22 and 24 and the protrusions 32 and 34 to air.

The present invention is not limited to the above-described embodiments, and various changes may be made thereto without departing from the scope of the invention.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat exchanger, comprising:

a plurality of coolant tubes including a first coolant tube and a second coolant tube; and a plurality of fins which facilitate a coolant passing through the plurality of coolant tubes to exchange heat with an ambient air, wherein each of the plurality of fins includes:

a plurality of fin parts spaced apart from each other;

a plurality of fin part connecting parts which connect the plurality of fin parts; and a plurality of protrusions which respectively protrude from separate ones of the plurality of fin parts, wherein each of the plurality of coolant tubes is shaped as a hollow straight pipe, wherein each of the plurality of fin part connecting parts includes a plurality of contacting parts, wherein each of the plurality of contacting parts for a specific fin part connecting part are spaced apart from each other and are parallel with each other, wherein two of the plurality of protrusions are disposed between two of the plurality of fin part contacting parts and are spaced apart from the two of the plurality of fin part contacting parts, and wherein the plurality of fin part contacting parts for a specific fin part connecting part and the two of the plurality of protrusions are disposed around the first coolant tube to be in contact with the first coolant tube.

2. The heat exchanger of claim 1, wherein at least one of the plurality of fin part connecting parts and at least one of the plurality of protrusions are provided at upper portions of the plurality of fin parts, and at least one of the plurality of fin part connecting parts and at least one of the plurality of protrusions are provided at lower portions of the plurality of fin parts.

3. The heat exchanger of claim 1, wherein a portion of each of the plurality of protrusions is parallel with a portion of each of the plurality of fin part connecting parts.

4. The heat exchanger of claim 1, wherein a length of one of the plurality of protrusions is less than a length of one of the plurality of fin part connecting parts.

5. The heat exchanger of claim 1, wherein each of the plurality of fin part contacting parts includes a curved surface which contacts a corresponding portion of the first coolant tube.

6. The heat exchanger of claim 1, wherein one of the plurality of fin part contacting parts is positioned in front of the coolant tubes, and another one of the plurality of fin part contacting parts is positioned in rear of the coolant tubes.

7. The heat exchanger of claim 1, wherein a first fin part connecting part of a first one of the plurality of fins contacts the first coolant tube and a second fin part connecting part of a second one of the plurality of fins contacts the first coolant tube.

8. The heat exchanger of claim 1, wherein a fin part of a first one of the plurality of fins contacts a fin part of a second one of the plurality of fins.

9. The heat exchanger of claim 1, wherein the plurality of fins include a circular hole between an opening of a first one of the plurality of fins and an opening of a second one of the plurality of fins, wherein the first coolant tube is provided through the circular hole.

10. A heat exchanger, comprising:

a plurality of coolant tubes including a first coolant tube and a second coolant tube; and a plurality of fins which facilitate a coolant passing through the plurality of coolant tubes to exchange heat with an ambient air, wherein each of the plurality of fins includes:

a plurality of fin parts spaced apart from each other, an upper fin part connecting part which connects with upper portions of two fin parts, a lower fin part connecting part which connects with lower portions of two fin parts, an upper opening at an upper portion of each of the plurality of fin parts, a lower opening at a lower portion of each of the plurality of fin parts, an upper protrusion which protrudes from an upper portion of each of the plurality of fin parts, and the upper protrusion which contacts the first coolant tube, and a lower protrusion which protrudes from a lower portion of each of the plurality of fin parts, and the lower protrusion which contacts the second coolant tube, wherein the upper fin part connecting part includes a first pair of contacting parts which contacts the first coolant tube, the lower fin part connecting part includes a second pair of contacting parts which contacts the first coolant tube, wherein the first pair of contacting parts are spaced apart from the second pair of contacting parts, and the second pair of contacting parts are parallel with the first pair of the contacting parts.

11. The heat exchanger of claim 10, wherein each of the plurality of coolant tubes is shaped as a hollow straight pipe, and wherein each pair of contacting parts includes a curved surface which contacts a corresponding portion of the coolant tube.

12. The heat exchanger of claim 10, wherein the upper fin part connecting part which extends in a first direction with respect to one fin part, and the lower fin part connecting part which extends in a second direction with respect to the one fin part, the second direction being opposite to the first direction.

13. The heat exchanger of claim 10, wherein the upper protrusion which protrudes in a first direction with respect to one fin part, and the lower protrusion which protrudes in a second direction with respect to one fin part, the second direction being opposite to the first direction.

14. The heat exchanger of claim 10, wherein a portion of the upper protrusion is parallel with a portion of the upper fin part connecting part, and a portion of the lower protrusion is parallel with a portion of the lower fin part connecting part.

15. The heat exchanger of claim 10, wherein a lower fin part connecting part of a first one of the plurality of fins, which is at an upper side, and an upper fin part connecting part of a second one of the plurality of fins, which is at a lower side, which contacts the first coolant tube.

16. The heat exchanger of claim 10, wherein a lower fin part connecting part of a first one of the plurality of fins, which is at an upper side, which contacts an upper fin part connecting part of a second one of the plurality of fins, which is at a lower side.

17. The heat exchanger of claim 10, wherein the plurality of fins include a circular hole between a lower opening of a first one of the plurality of fins, which is at an upper side, and an upper opening in a second one of the plurality of fins, which is at a lower side, wherein the first coolant tube is provided through the circular hole.

18. The heat exchanger of claim 1, wherein a first one of the plurality of fin connecting parts includes a first plurality of contacting parts, and a second one of the plurality of fin connecting parts includes a second plurality of contacting parts, wherein the first plurality of contacting parts is spaced apart from the second plurality of contacting parts, and the second pair of contacting parts are parallel with the first pair of contacting parts.

* * * * *